US005450092A

United States Patent [19]

Das

[11] Patent Number: 5,450,092

[45] Date of Patent: * Sep. 12, 1995

[54] FERROELECTRIC SCANNING RF ANTENNA

[76] Inventor: Satyendranath Das, P.O. Box 574, Mt. View, Calif. 94042-0574

[ * ] Notice: The portion of the term of this patent subsequent to Apr. 19, 2011 has been disclaimed.

[21] Appl. No.: 54,022

[22] Filed: Apr. 26, 1993

[51] Int. Cl.[6] ..... H01Q 1/00

[52] U.S. Cl. ..... 343/787; 343/785; 343/786

[58] Field of Search ..... 343/787, 789, 785, 786; 333/158, 35, 99 S; H01Q 1/00

[56] References Cited

U.S. PATENT DOCUMENTS 4,809,011 2/1989 Kunz ..... 343/785
5,032,805 7/1991 Elmer et al. ..... 333/156

OTHER PUBLICATIONS

Walker, "Superconducting Superdirectional Antenna Arrays", IEEE Transactions On Antennas And Propagations, vol. AP-25, No. 6, Nov. 1977, pp. 885-887.

*Primary Examiner*—Donald Hajec
*Assistant Examiner*—Hoanganh Le

[57] ABSTRACT

The ferroelectric scanning RF antenna includes a ferroelectric material having conductors deposited thereon that are connected to an adjustable d.c. or a.c. voltage source. The scanning antenna is placed in an RF transmission line that includes appropriate input and output impedance matching devices such as quarter-wave transformers. The scanning section of the RF scanning antenna is constructed of two prismatic structures of a ferroelectric material. When the two prismatic structures are at the same zero bias voltage, then the RF energy passing through the antenna is not deflected and a boresight radiation pattern is obtained. Application of a bias voltage reduces the permittivity and the refractive index of the outer prismatic structure. The RF energy is refracted away from the normal at the interface between the prismatic surfaces and the radiation pattern is scanned in one direction. Application of a bias voltage reduces the permittivity and the refractive index of the inner prismatic structure. The input RF energy is refracted towards the normal at the boundary of the two prismatic surfaces and the RF radiation pattern is scanned in the opposite direction. The scanning part of the ferroelectric scanning RF antenna may be embedded as part of a monolithic microwave integrated circuit. The scanning part of the ferroelectric scanning RF antenna may be constructed of a thin ferroelectric film. The copper losses is reduced by using a high Tc superconductor material as the conducting surface. The ferroelectric material is operated in the paraelectric phase slightly above its Curie temperature.

20 Claims, 2 Drawing Sheets

FERROELECTRIC SCANNING RF ANTENNA

BACKGROUND OF THE INVENTION

1. Field of the Invention

The present invention relates to antennas for electromagnetic waves and, more particularly, to RF antennas whose radiation pattern may be scanned electronically.

2. Description of the Prior Art

In many fields of electronics, it is often necessary to scan the radiation pattern of antennas.

Ferroelectric materials have a number of attractive properties. Ferroelectrics can handle high peak power. The average power handling capacity is governed by the dielectric loss of the material. They have low switching time (such as 100 nS). Some ferroelectrics have low losses. The permittivity of ferroelectrics is generally large, as such the device is small in size. The ferroelectrics are operated at a constant temperature in the paraelectric phase i.e. slightly above the Curie temperature. The scanning part of the ferroelectric scanning RF antenna can be made of thin films, and can be integrated with other monolithic microwave/RF devices. Inherently, they have a broad bandwidth. They have no low frequency limitation as in the case of ferrite devices. The high frequency operation is governed by the relaxation frequency, such as 95 GHz for strontium titanate, of the ferroelectric material. The loss of the ferroelectric scanning RF antenna is low with ferroelectric materials with a low loss tangent. A number of ferroelectric materials are not subject to burnout. The ferroelectric scanning RF antenna is a reciprocal device i.e. it can be used for transmission and reception.

The optical deflection and modulation by a ferroelectric device has been studied. F. S. Chen, J. E. Geusic, S. K. Kurtz, J. G. Skinner and S. H. Wemple, "Light Modulation and Beam Deflection with Potassium-Tantalate-Niobate Crystals," J. Appl. Phys. vol. 37, No.1, pp. 388–398, January 1966 and T. Utsunomiya, K. Nagata and K. Okazaki, "Prism-Type Optical Deflector Using PLZT Ceramics," Jap. J. Appl. Phys. vol.24, Suppl. 24-3, pp. 169–171, 1985. A liquid ferroelectric optical switch has been reported. S. S. Bawa, A. M.Bindar, K. Saxena and Subhas Chandra, "Miniaturized total reflection ferroelectric liquid-crystal electro-optic switch," App. Phys. Lett. 57 (15), pp. 1479–81, 8 Oct. 1990.

In the U.S. Pat. No. 5,304,960 Das claimed ferroelectric total internal reflection switch. An antenna was fabricated by cutting periodic grooves into the side wall of an optimized ferrite-type dielectric waveguide, thereby forming a series of radiating elements. R. A. Stern, R. W. Babbitt and J. Borowick, A mm-wave Homogeneous Ferrite Scan Antenna," Microwave Journal, pp. 101–108, April 1987.

Ferroelectric scanning apertures have been discussed by Das. S. Das, "Scanning Ferroelectric Apertures," The Radio and Electronic Engineer, pp. 263–268, May 1974.

However, the impedance of the ferroelectric scanning aperture is very low and the efficiency of its radiation is very small. The present invention presents a high efficiency ferroelectric scanning RF antenna. The invention also presents (1) a thin film structure of the scanning section of the ferroelectric scanning RF antenna, (2) the use of ferroelectric liquid crystal as the scanning section and (3) the use of high Tc superconductor material in place of silver or gold type conductive material to reduce the conductive loss and thus increase the efficiency of the ferroelectric scanning RF antenna.

There are significant differences between the RF and optical deflectors. In the optical deflector, the light ray travels through a very small portion of the scanning section. In the scanning RF antenna, the RF energy will travel through the entire portion of the scanning section. The wavelength of RF is several orders of magnitudes greater than the optical wavelengths.

The dimensions of the optical deflector are many times the optical wavelengths. The optical beam diameter is many times the optical wavelength. The width of scanning part of the scanning antenna is generally a fraction of the RF wavelength. The biasing circuit, for the optical deflector, is far away from the optical beam. The biasing circuit, in the case of the RF antenna, has to be isolated, by design, from the RF circuit. The biasing field, in the case of the optical deflector, can be parallel or perpendicular to the direction of the electrical field of the optical beam. For the RF antenna the direction of the biasing field is parallel to the direction of the electrical field of the RF beam.

SUMMARY OF THE INVENTION

The general purpose of this invention is to provide an electronically controlled scanning RF antenna. The ferroelectric RF antennas are not susceptible to the magnetic fields and the active part of the ferroelectric has the capability for direct integration into the packaging and structures of monolithic microwave and millimeter wave integrated circuits (MMIC).

In phased arrays, antennas, with fixed radiation patterns, are used. When arrays are scanned away from the boresight position, the gain of the beam of the array decreases and, for some scan angles, grating lobes appear reducing the gain of the main beam. The use of the scanned antennas will (1) increase the efficiency of the radiated beam when the array is scanned simultaneously and synchronously with the antennas and (2) will eliminate the appearance of grating lobes.

By selecting the dimensions of the radiating aperture of the antenna, the antenna will perform as an antenna array with a narrow diameter beam particularly at millimeter wavelengths.

To attain this, the present invention contemplates the use of a transmission line formed from a ferroelectric material whose permittivity and the refractive index are changed by changing an applied d.c. or a.c. electric field in which it is immersed. When the permittivity and the refractive index of the scanning material are reduced, the radiation pattern is scanned from the boresight position.

It is an object of this invention to provide a voltage controlled ferroelectric scanning RF antenna which uses lower control power and is capable of handling high peak power. Another object of the present invention is to provide a scanning RF antenna the scanning portion of which can be integrated into the structure of microwave and millimeter wave monolithic integrated circuits.

These and other objectives are achieved in accordance with the present invention which comprises of an RF transmission line having an input matching section, a scanning section made into two prismatic structures, and an output matching and radiating section. The scanning section is constructed from a solid or liquid ferroelectric material, such as strontium-lead titanate, the permittivity and the refractive index of which change with the changes in the applied bias electric field. When the refractive index of the outer prismatic structure is reduced, the RF radiation pattern is scanned in one direction. When the refractive index of the inner prismatic structure is reduced, the radiation pattern is scanned in the opposite direction. By selecting an appropriate percentage of lead titanate in the strontium-lead titanate, the Curie temperature of the ferroelectric material can be brought slightly lower than the high Tc of a superconducting material.

With these and other objectives in view, as will hereinafter more fully appear, and which will be more particularly pointed out in the appended claims, reference is now made to the following description taken in connection with accompanying drawings.

DESCRIPTION OF THE PREFERRED EMBODIMENT

Figure 1:
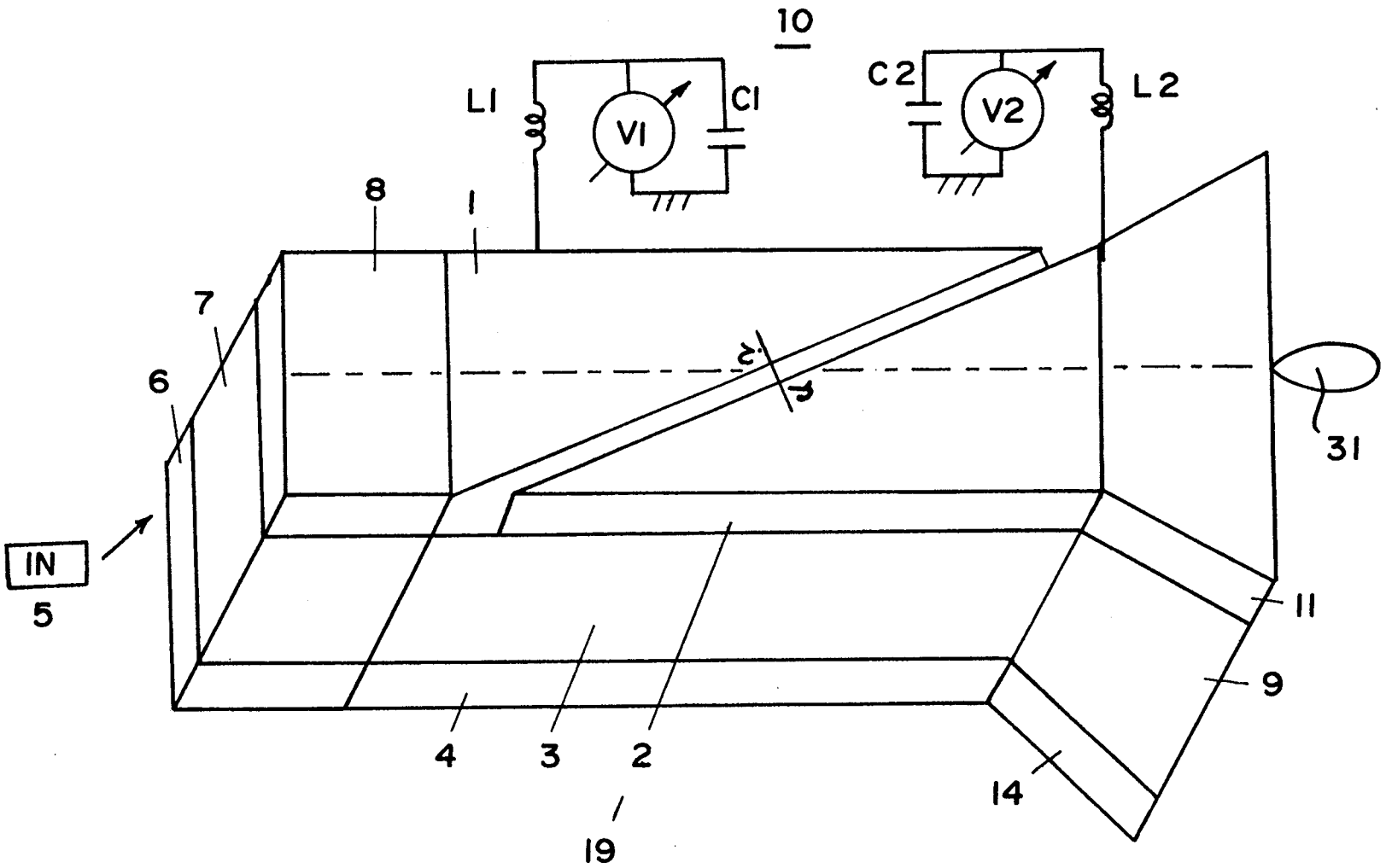
FIG.1 is a pictorial, schematic diagram of a typical embodiment.

Referring to the drawings there is illustrated in FIG. 1 a typical microwave or millimeter wave circuit that incorporates the principles of the present invention. Circuit 10 includes an RF input 5, an RF transmission line 19, and a radiated output 12.

The circuit 10 might be part of a cellular, terrestrial, microwave, satellite, radio determination, radio navigation or other telecommunication system. The RF input may represent a signal generator which launches a telecommunication signal onto a transmission line 19 for transmission and a radiated output 12.

The scanning ferroelectric material 3 is formed into two prismatic structures 1 and 2 by placing conductive depositions on top with an appropriate uncoated area between the top coated surfaces. The bottom surface 4 of the active medium is coated with a conductive material.

In addition to the scanning part 3 of the scanning antenna, the transmission line 19 contains a quarter-wave matching section 7 connected between the input of the scanning part of the scanning antenna 3 and the RF input 5 to match the impedance of the input of the scanning section 3 to the impedance of the RF input 5. The top 8 and the bottom 6 surfaces of the quarter-wave matching section 7 are deposited with a conductive material. To avoid a mismatch due to the reduction of permittivity of the input prismatic structure 1 on the application of a bias voltage, the quarter-wave matching section 7 can be made of a different ferroelectric material or the same material as that of the scanning material of the scanning antenna preferably with two quarter-wave sections of different impedances.

The output prismatic structure 2 of the scanning section 3 of the scanning antenna is connected to an odd multiple of quarter-wave impedance matching and radiating section 9. Both the upper 11 and the lower 14 surfaces of the odd multiple of quarter-wave section 9 are deposited with a conductive material. The output matching section 9 has an appropriate flare in both directions. To reduce the mismatch due to the reduction of permittivity of the output prismatic structure on the application of a bias voltage, the odd multiple of quarter-wave matching section can be made of a different ferroelectric material or the same material as that of the scanning material of the scanning antenna.

The entire scanning antenna, including both the input quarter-wave and the output odd multiple of quarter-wave matching section, can be made of the same ferroelectric material.

An adjustable d.c. or a.c. voltage source V2 is connected across the conductive surfaces 11 and 14. The inductor L2 provides a high impedance path to the RF energy and the capacitor C2 provides a low impedance path to any remaining RF energy at the end of the inductor L2.

An adjustable d.c. or a.c. voltage source V1 is connected across the conductive surfaces 1 and 4. The inductor L1 provides a high impedance path to the RF energy and the capacitor C1 provides a low impedance path to any remaining RF energy at the end of the inductor L1.

The RF energy, fed at the input 5, is incident at the interface between the two prismatic structures at an angle i on the first prismatic structure and refracted at an angle r on the second prismatic structure. Without any bias voltage applied between 1 and 4 and between 11 and 14 i.e. between 2 and 4, the angle of incidence is equal to the angle of refraction, and the RF energy is transmitted and finally radiated with a boresight far field radiation pattern 31. The transmission is governed by Snell's law. With a bias voltage V2 applied between 11 and 14, the permittivity and the refractive index of the second output prismatic structure 2 decrease, and the RF energy is transmitted at an angle away from the normal at the interface between the two prismatic structures and the RF beam is deflected towards the top of the page. The larger the magnitude of the bias voltage V2, the larger the scanning or deflection. With a bias voltage V1 applied between the surfaces 1 and 4, the permittivity and the refractive index of the input prismatic structure are reduced, and the RF energy is refracted towards the normal at the interface between the two prismatic structures and the RF energy is scanned or deflected from the boresight position towards the bottom of the page.

In order to prevent undesired RF propagation modes and effects, the height and the width of the transmission line 19 need to be controlled.

The scanning ferroelectric material 3 and the quarter-wave matching transformer 7 could be in thin film configuration.

Figure 2:
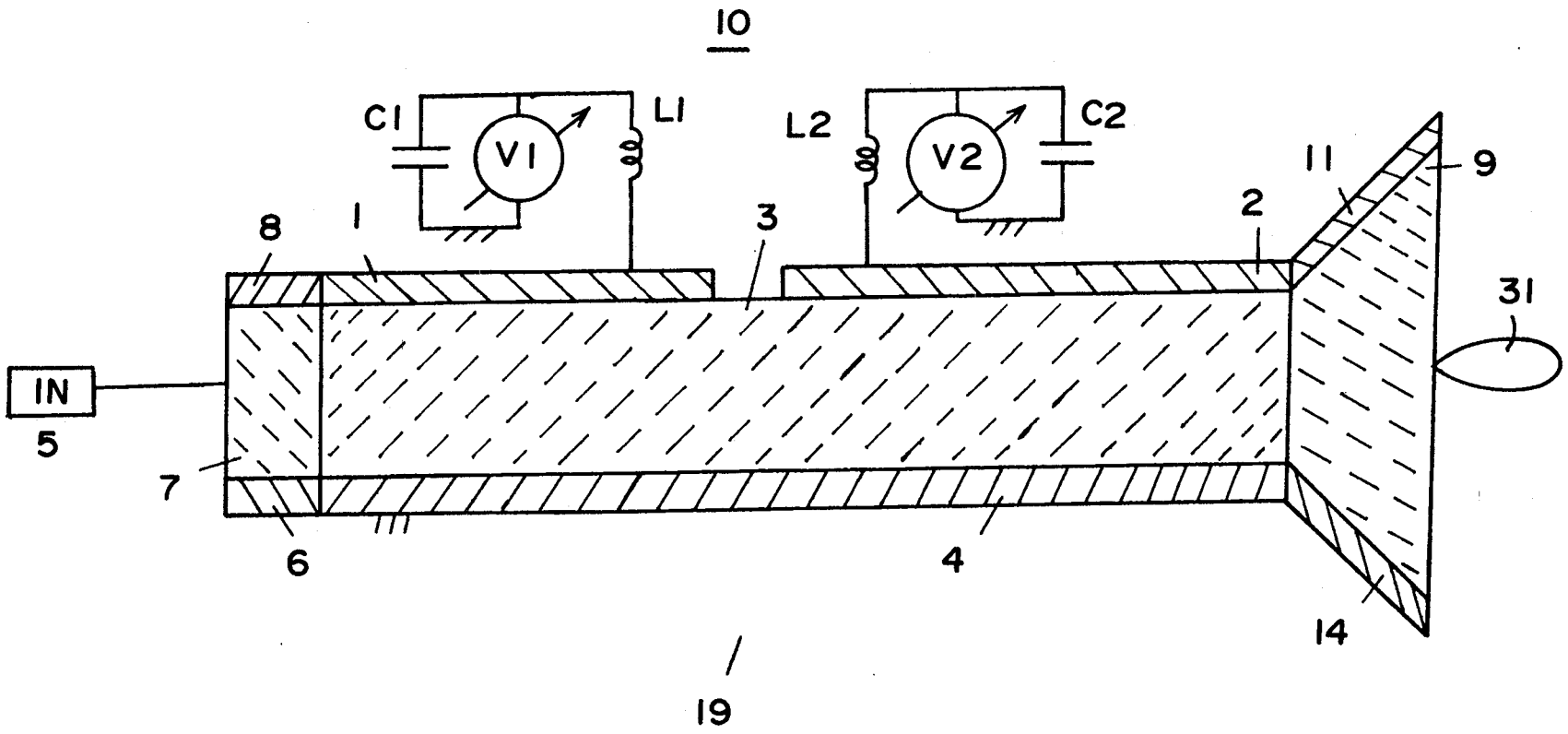
FIG. 2 is a schematic longitudinal section of a typical embodiment.

FIG. 2 shows a longitudinal cross-section of the same circuit 10 through the middle of the scanning antenna. The scanning element is 3. The input prismatic structure is formed by a conductive deposition 1 on top of the scanning material 3. The output prismatic structure is formed by a conductive deposition 2 on top of the scanning material 3. The bottom surface 4 of the scanning material is deposited with a conductive material. Between the RF input 5 and the input prismatic structure 1, there is a quarter-wave matching transformer 7. The top 8 and bottom 6 surfaces of the quarter-wave matching transformer 7 are deposited with a conductive material. At the end of the output prismatic structure, there is a matching dielectric section 9. It's length is a multiple of odd quarter-wavelength, such as 1, 3, 5 of the operating wavelength in the dielectric. The dielectric or ferroelectric section 9 is flared out, in both directions, with an appropriate angle for proper matching the output prismatic structure to the free space impedance of 377 ohms. The top 11 and bottom 14 surfaces of the output matching dielectric 9 are deposited with a conductive material. The RF input 5 travels through the scanning antenna and is transmitted with a far field radiation pattern 31. A d.c. or a.c. bias voltage V1 is applied to the input prismatic structure 1 through an inductor L1 which provides a high impedance to the RF energy. C1 provides a short circuit path to any remaining RF present at the end of the inductor L1. When a voltage V1 is applied to the input prismatic structure between 1 and 4, the RF beam is scanned towards the bottom of the page. A voltage source V2 is connected to the output prismatic structure through the inductor L2 which provides a high impedance to the RF energy and C2 provides a low impedance path to any RF energy remaining at the end of L2. When a voltage V2 is applied to the output prismatic structure between 2 and 4, the beam is deflected to the top of the page. Either V1 or V2 is applied at a time, they are not applied simultaneously.

A microstrip line configuration is shown in FIG. 1 and FIG. 2 as a discrete device. However, the same drawings will depict the scanning portion of a ferroelectric scanning antenna and it's input quarter-wave matching transformer in a monolithic microwave integrated circuit (MMIC) configuration as a part of a more comprehensive circuit. The conductive depositions are microstrip line conductors.

It should be understood that the foregoing disclosure relates to only typical embodiments of the invention and that numerous modification or alternatives may be made therein by those of ordinary in skill in the art, without departing from the spirit and the scope of the invention as set forth in the appended claims.

What is claimed is:

1. A ferroelectric scanning RF antenna having an input, an output, electric field dependent permittivity, comprising of:

a body of a solid ferroeletric material having a top and a bottom surface and a permittivity and refractive index that are functions of an electric field in which it is immersed;

the said body of a solid ferroelectric material being formed into input and output prismatic structures by placing conductive depositions, separated by an appropriate uncoated area, on the top surface;

a quarter wave transformer with conductors on the top and bottom surfaces for coupling RF energy into said body;

an odd quarter wave transformer with conductors on the top and bottom surfaces for coupling RF energy from said body;

means for applying an electric field to the output prismatic structure of the said body to reduce the permittivity and the refractive index of the output prismatic structure to obtain deflection of input RF energy at the interface between the input and the output prismatic structures and scanning of the radiated beam;

means for applying an electric field to the input prismatic structure of the said body to reduce the permittivity and the refractive index of the input prismatic structure to obtain deflection of input RF energy at the interface between the input and the output prismatic structures and scanning of the radiated beam in the opposite direction; and the said antenna being operated at a constant temperature appropriately above the Curie temperature of the ferroelectric material.

2. The ferroelectric scanning RF antenna of claim 1 wherein a ferroelectric liquid crystal (FLC) is used as the ferroelectric material.

3. A ferroelectric scanning RF antenna having an input, an output, electric field dependent permittivity, comprising of:

a body of a first ferroelectric material having a top and a bottom surface and a permittivity and refractive index that are functions of an electric field in which it is immersed;

the said body of a first ferroelectric material being formed into input and output prismatic structures by placing two microstrip line conductors, separated by an appropriate uncoated area, on the top surface;

a first microstrip line ferroelectric quarter-wave matching transformer for matching the impedance of the input of the antenna to the impedance of the first ferroelectric material;

a second microstrip line ferroelectric odd quarter-wave matching transformer for matching the impedance of the first ferroelectric material to the output impedance of free space;

voltage means for applying an electric field to the output prismatic structure to reduce the permittivity and the refractive index of the prismatic structure to obtain deflection of the incident RF energy at the interface between the input and the output prismatic structures and scanning of the radiated beam;

voltage means for applying an electric field to the input prismatic structure to reduce the permittivity and the refractive index of the input prismatic structure to obtain deflection of the incident RF energy at the interface between the input and the output prismatic structures and scanning of the radiated beam in the opposite direction; and the said antenna being operated at a constant temperature appropriately above the Curie temperature of the ferroelectric material.

4. The ferroelectric scanning RF antenna of claim 2 wherein the same ferroelectric material is used for the prismatic structures, first and second matching transformers.

5. The ferroelectric scanning antenna of claim 2 further having a flare in both dimensions of the radiating aperture of the scanning antenna to produce a narrow diameter beam as obtained from an array of antennas.

6. The ferroelectric scanning RF antenna of claim 2 wherein the conductors are made of a high Tc superconductor material and the scanning antenna is operated at the high Tc superconducting temperature to minimize the conductive losses.

7. The ferroelectric scanning RF antenna of claim 3; wherein the said antenna has a flare in both dimensions of the radiating aperture to produce a narrow diameter beam as obtained from an array of antennas; and the scanning antenna is operated at a constant high superconducting temperature.

8. The ferroelectric scanning Rf antenna of claim 3 wherein the ferroelectric material is used for the prismatic structures, first and second matching transformers; and the scanning antenna is operated at a constant high superconducting temperature.

9. The ferroelectric scanning RF antenna of claim 3 wherein the same ferroelectric material is used for the prismatic structures, first and second matching transformers;

the conductors are made of a film of a single crystal high Tc superconductor; and the scanning antenna is operated at a constant high superconducting temperature.

10. A ferroelectric scanning RF antenna of claim 3 wherein the first and second quarter-wave transformers are made of a dielectric material.

11. The ferroelectric scanning RF antenna of claim 10 further having a flare in both dimensions of the radiating aperture of the scanning antenna to produce a narrow diameter beam as obtained from an array of antennas.

12. A ferroelectric scanning antenna having an input, an output, electric field dependent permittivity, comprising of:

a film of a first ferroelectric material having a top and a bottom surface and a permittivity and refractive index that are functions of an electric field in which it is immersed;

the said film of a first ferroelectric material being formed into input and output prismatic structures by placing two microstrip line conductors, separated by an appropriate uncoated area, on the top surface;

a first microstrip line ferroelectric film quarter-wave matching transformer for matching the impedance of the input circuit to the impedance of the first ferroelectric film;

a second microstrip line ferroelectric film odd quarter-wave matching transformer for matching the impedance of the first ferroelectric film to the output impedance of the free space;

voltage means for applying an electric field to the output prismatic structure to obtain deflection of the input RF energy at the interface between the input and the output prismatic structures and scanning of the radiated beam;

voltage means for applying an electric field to the input prismatic structure to obtain deflection of the input RF energy at the interface between the input and the output prismatic structures and scanning of the radiated beam in the opposite direction; and the said antenna being operated at a constant temperature appropriately above the Curie temperature of the ferroelectric material.

13. A ferroelectric scanning antenna of claim 12; wherein the conductors are made of a high Tc superconductor materials; and the scanning antenna being is operated at a constant high superconducting temperature.

14. The ferroelectric scanning antenna of claim 12; wherein the said input and output prismatic structures and the first quarter wave transformer are being a MMIC;

the conductors are made of a high Tc superconductor materials; and the scanning antenna is operated at a constant high superconducting temperature.

15. A ferroelectric scanning antenna of claim 12; wherein the said input and output prismatic structures and the first quarter wave transformer are a MMIC;

the conductors are made of a film of a single crystal high Tc superconductor; and the scanning antenna is operated at a constant high superconducting temperature.

16. The ferroelectric scanning antenna of claim 12; wherein the said antenna has a flare in both dimensions of the radiating aperture to produce a narrow diameter beam as obtained from an array of antennas; and the scanning antenna is operated at a constant high superconducting temperature.

17. The ferroelectric scanning RF antenna of claim 12 wherein the ferroelectric material is used for the prismatic structures, first and second matching transformers;

the said input and output prismatic structures and the first quarter wave transformer are a MMIC;

the conductors are made of a film of a single crystal high Tc superconductor; and the scanning antenna is operated at a constant high superconducting temperature.

18. The ferroelectric scanning RF antenna of claim 12 wherein the first and second quarter-wave transformers are made of a dielectric material.

19. The ferroelectric scanning RF antenna of claim 18 further having a flare in both dimensions of the radiating aperture of the scanning antenna to produce a narrow diameter beam as obtained from a an array of antennas.

20. The ferroelectric scanning RF antenna of claim 19 wherein the first quarter wave transformer and the said input and output prismatic structures are a MMIC.

* * * * *

UNITED STATES PATENT AND TRADEMARK OFFICE

CERTIFICATE OF CORRECTION

PATENT NO. : 5,450,092
DATED : Sep. 12, 1995
INVENTOR(S) : Satyendranath Das

It is certified that error appears in the above-indentified patent and that said Letters Patent is hereby corrected as shown below:

Column 6, claim 4, line 1.

The numeral "4" is deleted and is replaced by - - 21 - - and "2" is replaced by - - 12 - -.

2. Column 6, claim 5, line 1. The numeral "5" is deleted and is replaced by - - 22 - - and "2" is replaced by - - 12 - -.

3. Column 6, claim 6, line 1. The numeral "6" is deleted and is replaced by - - 23 - - and "2" is replaced by - - 12 - -.

Signed and Sealed this

Twenty-fourth Day of June, 1997

Bruce Lehman

*Attest:*

BRUCE LEHMAN

*Attesting Officer*

*Commissioner of Patents and Trademarks*